US005295753A

United States Patent [19]

Godo et al.

[11] Patent Number: 5,295,753

[45] Date of Patent: Mar. 22, 1994

[54] LABEL TAPE PRINTING SYSTEM USING THERMAL HEAD AND TRANSFER INK RIBBON

[75] Inventors: Hiroki Godo; Tsutomu Yamazaki, both of Suwa, Japan

[73] Assignee: Seiko Epson Corporation, Tokyo, Japan

[21] Appl. No.: 23,751

[22] Filed: Feb. 24, 1993

Related U.S. Application Data

[63] Continuation of Ser. No. 700,674, May 15, 1991, abandoned.

[30] Foreign Application Priority Data

May 17, 1990 [JP] Japan ..... 2-127247
May 17, 1990 [JP] Japan ..... 2-127426

[51] Int. Cl.[5] ..... B41J 15/16

[52] U.S. Cl. ..... 400/612; 400/88; 400/207; 400/613; 400/615.2; 156/277

[58] Field of Search ..... 400/88, 120, 207, 208, 400/612, 613, 615.2, 641; 101/420, 18; 428/204, 206, 223; 427/121; 157/277; 118/46

[56] References Cited

U.S. PATENT DOCUMENTS 2,555,319 6/1951 Cross ..... 101/420
3,834,507 10/1974 Bradshaw ..... 400/613 X
4,480,936 11/1984 Kasun ..... 400/207
4,504,837 3/1985 Toyoda ..... 346/1.1
4,773,775 9/1988 Bradshaw ..... 400/208
4,832,514 5/1989 Basile ..... 400/120
4,836,697 6/1989 Plotnick ..... 400/120
4,861,176 8/1989 Distefano ..... 400/208
4,917,514 4/1990 richardson ..... 400/120
4,976,558 12/1990 Kuzuya ..... 400/615.2
5,056,940 10/1991 Basile ..... 400/120

FOREIGN PATENT DOCUMENTS 11611 1/1976 Japan .

*Primary Examiner*—Edgar S. Burr
*Assistant Examiner*—Eric P. Raciti
*Attorney, Agent, or Firm*—W. Douglas Carothers, Jr.

[57] ABSTRACT

A label tape printer has a more-or-less conventional label tape cassette gear train mechanism except that the main motor has a clutching means that can disengage the motor when the motor is not on and turning. This allows the motor loads to turn the gear trains without any tendency of the motor to hold the gear train frozen by its advantage through the gear reduction. Therefore a pull on the label tape end will result in the entire gear train turning and thereby preventing the ink ribbon from forming a loose loop that can get sucked into an adhesive tape sandwich (with catastrophic results). The label tape cassette is provided with a guide roller having deep grooves, giving the appearance of a piece of machine screw threaded stock, that is positioned to keep the adhesive tape from sticking to the inside walls if the tape reels loosen. The adhesive tape has a reduced surface area on the guide roller to become stuck on it also.

9 Claims, 7 Drawing Sheets

LABEL TAPE PRINTING SYSTEM USING THERMAL HEAD AND TRANSFER INK RIBBON

This application is a continuation of U.S. Ser. No. 07/700,674 filed May 15, 1991, now abandoned.

BACKGROUND OF THE INVENTION

This invention relates generally to label tape printers and more particularly to label tape cassettes and their drive mechanisms.

Label tape printers and associated print cassettes have recently become popular. These printers have an ancestor in the form of the DYMO TM plastic label maker that was popular in the United States in the 1960's and 1970's. The DYMO machine embosses characters into plastic tape. See, for example, U.S. Pat. No. 4,624,590; and tape and ribbon cartridges described in U.S. Pat. Nos. 4,226,547; 4,391,539; and 4,678,353. A more recent label printer is the KROY lettering machine (Kroy, Inc., Scottsdale, Aeiz.). See, for example, U.S. Pat. No. 4,832,514, issued May 23, 1989, to Basile; and U.S. Pat. No. 4,836,697, issued Jun. 6, 1989, to Plotnick, et al. as well as U.S. Pat. Nos. 3,834,507; 4,243,333; 4,402,619; and 4,462,708. Hirosaki, et al., describes in U.S. Pat. No. 4,666,319, issued May 19, 1987, a typical printer in which character images are formed into strips of tape by transferring ink or other color from color carrying ribbon to the tape by localized application of heat and pressure. The new label tape printers are able to print a line of characters on an adhesive tape strip that is cut off at the end of the print line and which can be adhered to surfaces, similar to SCOTCH brand tape. The label tape used in these printers is special, and comes ready-to-use in a tape cassette that includes an ink ribbon for the print head. The finished tape output from the printer consists of three parts, a transparent tape on which ink is printed, a double sided, adhesive tape, and a backing that is subsequently peeled-off to expose an adhesive surface for applying the label tape to a desired surface.

The backing and adhesive tape are positioned on a first reel inside an unused cassette, the transparent tape is on a second reel, and the ink ribbon, usually of a thermal ink type, is provided on a third reel. Used ink ribbon is taken up on a fourth reel. To print a label, the ink ribbon and print head are brought into contact with the transparent tape. A reverse image is printed by the head on the transparent tape so that the image will read correctly when view through the tape. The transparent tape is thereafter pressed together with one side of the adhesive tape such that the printed ink is sandwiched between the two tape layers. In this manner, the printed ink will not be exposed and rubbed off. On the other surface of the adhesive tape is a peel-off backing material. After the two tape layers have been pressed together, the composite tape exits one end of the tape cassette, and a cutting unit usually cuts the tape after the line of print has been completed. The user then pulls the printed piece of label tape from the printer for use.

These printers employ a complex series of interconnected gears, pulleys, and rollers to manage the operations of printing, feeding, and tape assembly during use of the printer. See for background, U.S. patent application of Hiroki Godo, et al., Ser. No. 07/609,501, filed Nov. 11, 1990, entitled "Tape Printer", now U.S. Pat. No. 5,193,919. During the printing operation, it is important that the ink ribbon and transparent label tape move together at the same rate. This prevents the possible rubbing of the two together causing smudging of the ink on the label tape. The least amount of tape will be wasted if the label tape and the adhesive tape are pressed together and cut near the point of printing in the printer. However, to assemble these tapes, the ink ribbon must be moved out of the way as quickly as possible after serving its purpose at the thermal print head. Since the ink is deposited on the inside of the two sandwiched tapes, and since the tapes must be sandwiched very close to the point of printing, the ink ribbon, by necessity, must be positioned very close to the tape pressure roller assembly employed for pressing the two tape layers together. An extremely important function, therefore, of the printer gearing mechanism is to maintain the ink ribbon taunt in its travel through the printer so as not to interfere with other operating parts of the printer.

Most of the time the label tape and ribbon transport mechanism functions as intended. But in conventional label tape drive mechanisms, if a user pulls on a tape prior to being cut, the gear mechanism for the tape rollers and reels will be moved against the resistance of the tape transport motor and its associated high reduction gears. The usual and catastrophic result is that the ink ribbon becomes entangled and caught in the tape pressure rollers utilized for pressing the transparent tape to the adhesive tape. Once the ink ribbon has been ensnared between these rollers and tape layers, the entire cassette is of no further utility, and the damage cannot readily be undone or the tapes cannot be untangled. Moreover, cutting the tape off with the cutter also cuts the entangled ink ribbon. The ink ribbon cannot then be effectively fed onto its take-up reel because it is effectively out of operation. Given human nature, and a typical user's impatience with tape feeding and cutting, the above scenario is all too common an occurrence.

The present invention solves the above problem by allowing the user to proceed with early removal of the label tape from the printer, by arranging the gear mechanisms so that the gears are freed from enagement with the printer drive motor. The various tape and ink ribbon reels, gear mechanisms, and rollers will maintain their proper respective functions with the ink ribbon kept taunt by continually taken up on its take-up reel because tape tension does not become loose and tape to become pulled into the final tape assembly.

A second, related problem is also solved by the present invention. The adhesive tape has an exposed adhesive surface during its travel between the adhesive tape supply reel and the pressure rollers that combine the adhesive tape with the transparent tape.A guide roller is needed between the adhesive tape supply reel and the pressure rollers to keep the adhesive tape from wandering from its proper path of travel of dislocating and adhering to the inside walls of the cassetts, or worse, to the ink ribbon. But ordinary cylindrical guide rollers provide the adhesive tape with too much surface for attachment and, as a result, become attached to the guide roller surface, especially after long idle periods of nonuse of the printer. A guide roller having deep grooves and ridges, much like the appearance of a machine screw threaded stock, is employed to solve this problem.

SUMMARY OF THE INVENTION

According to this invention, a label tape printer is provided with a conventional label tape cassette gear train mechanism except that a motor clutch type of element is employed to disengage the motor from an associated gear train when the motor is not being operated. This allows the gear train to be free wheeling without any tendency of the motor to hold the gear train fixed by its advantage through gear reduction. Therefore, pulling on the end of the label tape results in the entire gear train to be free turning preventing the ink ribbon from forming a loose loop and brought into contact with a composite label tape/adhesive tape creating catastrophic results. Moreover, a label tape cassette is provided with a guide roller having deep grooves, providing a surface appearance similar to a machine screw threaded stock, and is positioned to keep the adhesive tape from adhering to the cassette inside walls if the tape reel tension becomes slack and moreover, provides reduced contact surface area on the guide roller surface so that the adhesive tape does not become secured to the guide roller surface.

An advantage of the present invention is that the rather innocent act of a user pulling on a label tape end will not permanently damage a label tape cassette.

Another advantage of the present invention is that adhesive tape inside the tape cassette will not become attached to the inside walls of the cassette or become attached to the guide roller that keeps the tape away from the inside walls.

Another advantage of the present invention is that even if a user pulls on exiting label tape from the printer, any slack in the thermal ink ribbon will be taken up on a ink ribbon reel core. The thermal ink ribbon will, therefore, not sag between a print head and the ribbon take-up core. Therefore, it is possible to maintain an ideal peel off angle resulting in excellent print quality.

Another advantage of the present invention is that overfeeding of the thermal ink ribbon in the tape cassette is prevented, eliminating the hazard of rendering the tape cassette unusable.

Another advantage of the present invention is that the present invention allows for a reduction in the amount of force required to pull the adhesive tape out of the printer in conjunction with the label tape because the contact adhesion between the adhesive tape and its guide tape roller is reduced, and the amount of electric power consumed by the motor can also be reduced thereby extending battery life.

Other objects and attainments together with a fuller understanding of the invention will become apparent and appreciated by referring to the following description and claims taken in conjunction with the accompanying drawings.

DESCRIPTION OF THE PREFERRED EMBODIMENTS

Figure 1B:
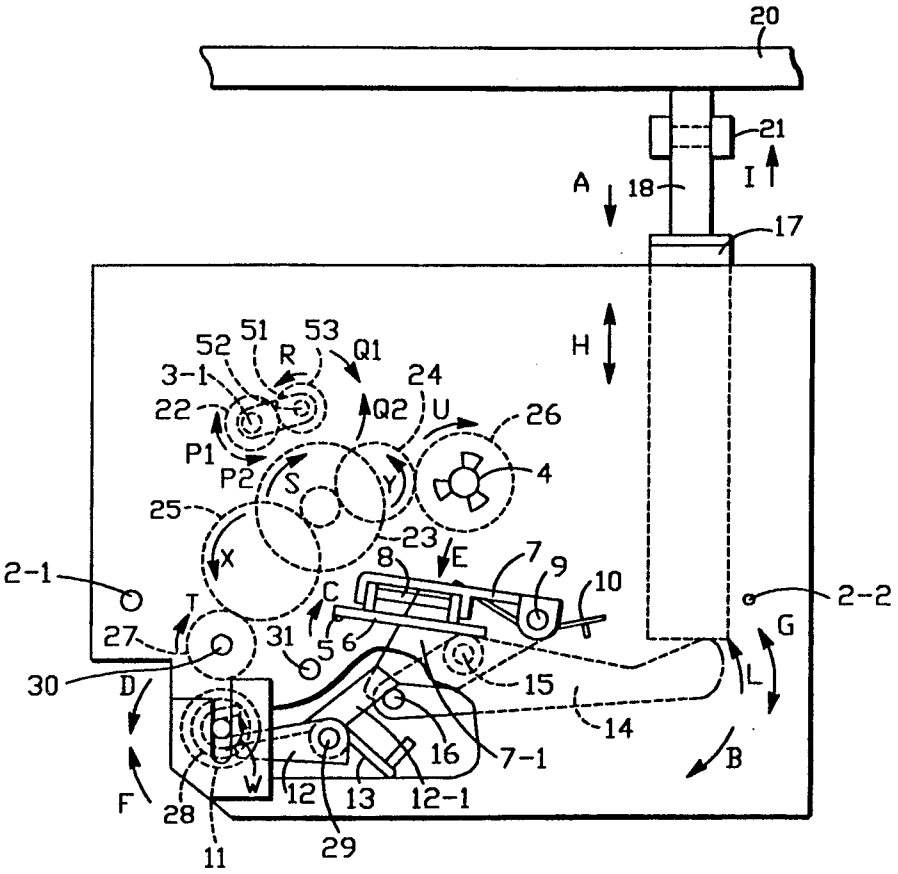
FIG. 1B is a top view of the mechanism of FIG. 1A with some of the gears shown in phantom view that are located behind a base plate.

Referring to FIG. 1, a print mechanism (60, FIG. 6) comprises a frame 1 and a base plate 2. A print head assembly mounted on base plate 2 comprises a thermal print head 5, a head support 6, a head arm 7, a head support shaft 8, a head arm shaft 9, and a head hold-down spring 10. Label tape is gripped and released by a retractable roller assembly mounted on base plate 2, and the assembly comprises a tape feed roller 11, a swing arm 12, a spring 13, a release lever 14, and a release lever support sleeve 15, all of which rotate on a shaft 16 when a pushrod 17 engages a cover cam 18. As will be evident through subsequent explanation, the drive force of tape feed roller 11 and its associated hold-down roller 36 in the tape cassette are the exclusive means for unwinding and joining together label tape 33 and adhesive tape 37.

Cover cam 18 is preferably an integral projection formed in the molding process of manufacturing case cover 20. The head arm 7 has a section 7-1 that makes direct contact with release lever shaft 16. Arm 7 rotates a short distance on head arm shaft 9. Head support shaft 8 allows head support plate 6 and print head 5 to wobble slightly in and out at the label tape edges on head arm 7. Head hold down spring 10 is wound around shaft 9 and forces head arm 7 to swing on shaft 9 in a direction of arrow "E". The use of spring pressure allows some amount of "give" between print head 5 and a platen roller 35, which is carried in the tape cassette and slips over shaft 31. Notwithstanding the small amount of give, enought pressure will be maintained over the range of movement to produce good printing results.

Tape feed roller 11 rotates on shaft 28-1 and is driven by tape feed gear 28. Tape feed roller swing arm 12 has a contact area 12-1 and can slightly pivot around on shaft 29. This swinging action of arm 12 allows tape feed gear 28 to be engaged with or disengaged from gear 27. When so engaged, roller 11 presses against an opposing or hold-down roller 36 which is supported in the tape cassette and slips over shaft 30. Printer case 19 contains the above mechanisms and has a cover 20 that can open to receive a label tape cassette. In this connection, see the discussion below for FIGS. 4 and 5 regarding the operation of release lever 14 the occurs as a consequence of opening cover 20.

Referring again to FIG. 1B, spring 13 is wound around shaft 28-1 biasing roller 11 in the direction indicated by arrow "F". This allows some give between tape feed roller 11 and opposing roller 36. In any case, adequate pinching pressure is maintained between these contacting rollers. Release lever 14 carries shaft 15 so that it makes contact with the frame and is able to rotate back and forth in the direction indicated by arrow "G". Pushrod 17 is held in position by base plate 2 and is able to move in opposite directions, as indicated by arrow "H". One end of pushrod 17 is in contact with one end of release lever 14. Opening case cover 20 moves release lever 14 and the platen roller holder so that thermal head 5 is moved away from platen roller 35. Closing cover 20 will cause release lever 14 to load the thermal print head on the platen 35.

This invention differs from conventional label printers in that the printer motor can be automatically disengaged from the gear train supplying drive power to drive roller 11 and ink ribbon take-up reel 26. Stepper motor 3 is connected to drive gear 22. A planetary (epicyclic) gear assembly frame 51 is supported by motor shaft 3-1 and carries a shaft 52 and a planetary gear 53 which is driven by motor gear 22. Although motor 3 is a stepper type motor in this embodiment, a DC motor with appropriate position sensors may be employed. When motor 3 turns in a direction indicated by arrow "P1", gear 22 will also turn in direction "P1" and frame 51 will rotate in a direction indicated by arrow "Q1" so that gear 53 engages reduction gear 23. As motor 3 continues to rotate, frame 51 slips on shaft 3-1 and planetary gear 53 is held under slight pressure in engagement with gear 23. Along a first drive power path, transfer gear 24 is driven by gear 23 and rotates ink ribbon take-up shaft 4 and gear 26 in direction indicated by arrow "U". Ribbon take-up shaft 4 has a friction clutch and maintains tension and winds up ink ribbon 34 in the tape cassette by rotation of take-up reel 26 in direction "U". Along a second drive power path, a transfer gear 25 is driven by gear 23 and rotates tape feed transfer gear 27. Gear 28 engages transfer gear 27 and provides drive power to tape drive roller 11 when cover 20 is closed wherein release lever 14 has been moved in direction indicated by arrow "L".

Figure 2A:
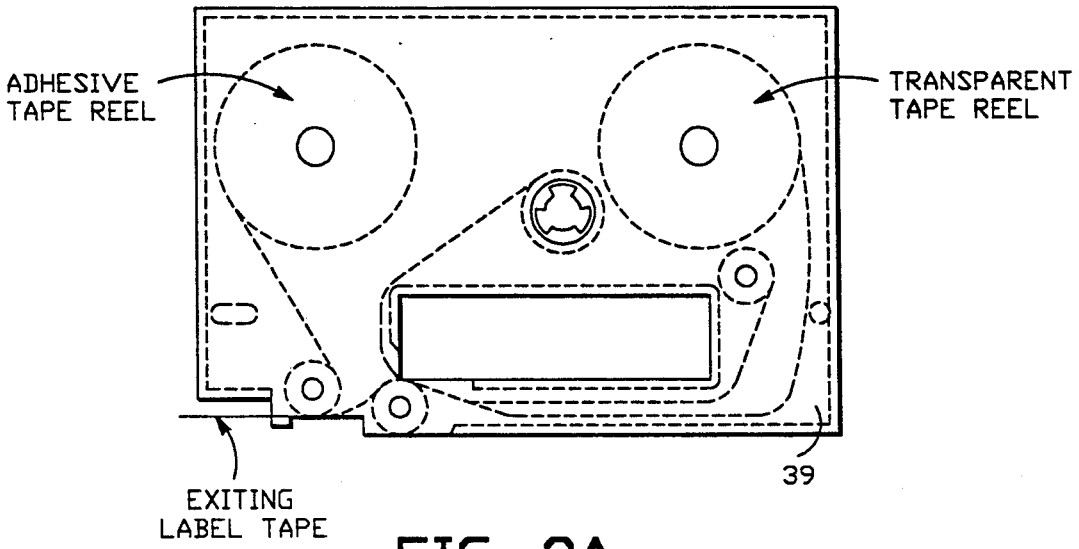
FIG. 2A is a top view of a label tape cassette that can be loaded on the mechanism of FIGS 1A-1B. Elements located inside the cassette and not visible without removal of the top cover and are, therefore, shown in phantom view.
Figure 2B:
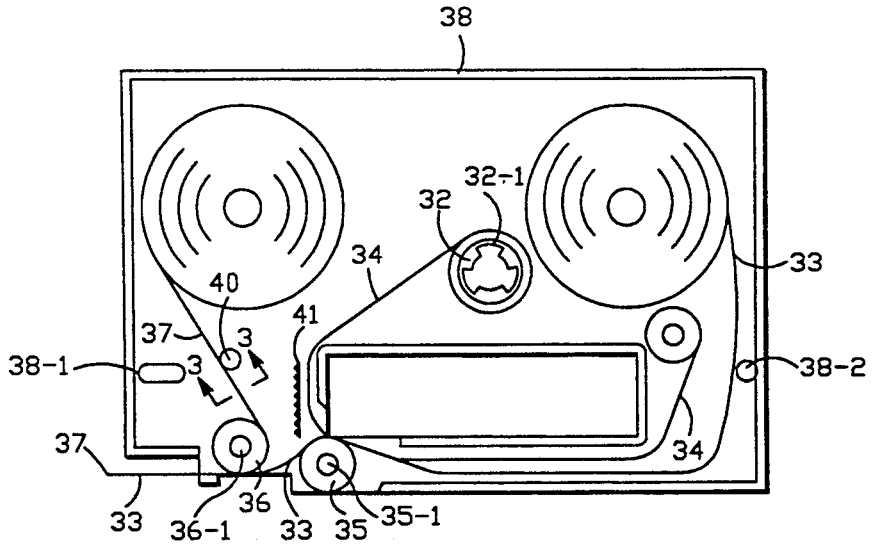
FIG. 2B is a top view of the cassette of FIG. 2A with the top cover removed.

In FIGS. 2A–2B, a tape label cassette compatible with the above described printer mechanism is shown employing ribbon take-up core 32, transparent tape 33 with a corresponding supply reel, tape platen roller 35, adhesive tape opposing or hold-down roller 36, and an adhesive tape 37 and corresponding supply reel, all of which are housed between a cassette case bottom 38 and top 39. Platen roller 35 rotates on a hollow axle shaft which has an opening 35-1 to receive platen roller shaft 31 for rotatable support. Transparent tape hold-down roller 36 also rotates on a hollow shaft having opening 36-1. Tape feed transfer gear shaft 30 will slip into hole 36-1. However, shaft 30 does not drive roller 36. The only tape drive force for both the adhesive tape 37 and the label tape 33 comes from driver roller 11, which is firmly biased against label tape 33 and roller 36 so that there is sufficient pinching pressure to pull label tape 33 through its transfer path in the cassette.

Thermal ink ribbon 34 is wound up on ribbon take-up core 32. The splined opening 32-1 of core 32 is engaged by ribbon take-up shaft 4 when the cassette is installed on the drive mechanism of FIG. 1 thereby providing the required drive force necessary to advance the ink ribbon 34 during printing. Transparent tape 33 is joined with adhesive tape 37 between drive roller 11 and opposing roller 36. A separation material on tape 37 keeps the tape from adhering to itself and functions as a peel-off backing for applying the printed label tape to a surface. Tape guide roller 40 is positioned on the exposed adhesive side surface of adhesive tape 37 and is properly positioned to maintain adhesive tape 37 from shifting from its path and, perhaps, accidentally becoming attached to the inside walls or other structures of the cassette. Guide roller 40 is freely rotatable and, therefore, sufficiently able to break free of attachment developed between the roller surface and adhesive tape 37. To reduce the ability of adhesive tape 37 to become attached to undesirable surfaces, guide roller 40 has a special shape, which is described below with reference to FIG. 3. Although FIG. 2B shows only one guide roller 40, more than one guide roller may be utilized in the cassette, especially if the exposed path of adhesive tape 37 is long. Notwithstanding the number and positioning of such guide rollers, a small, sharp bulge can form in adhesive tape 37 around the surface of roller 36. This bulge can come in contact with the inside walls of the cassette or worse, can come in contact with ink ribbon 34. Moreover, wall area 41 is provided with a plurality of peaks or ridges providing a reduced contact surface area for adhesive tape 37. Wall area 41 may be positioned near the location of roller 36. Guide roller 40 and wall area 41 form an adhesive tape guide assembly.

Cassette case bottom 38 has a pair of alignment holes 38-1 and 38-2 that engage a matching pair of tape cassette alignment shafts 2-1 and 2-2 (FIG. 4B), respectively. A cassette case top 39 fits over the case bottom 38 and is only shown in FIG. 2A for purposes of clarity of the other structures.

Figure 3:
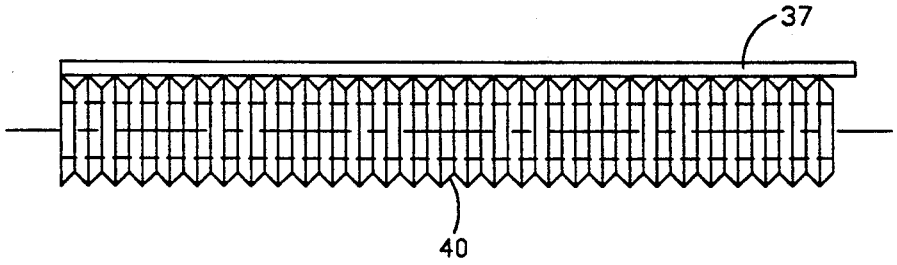
FIG. 3 is a view of the adhesive tape guide roller and a cross-section of the adhesive tape taken along the line 3—3 in FIG. 2B. Only the ridges or peaks of the guide roller surface come into contact with a adhesive coated side of the adhesive tape. The guide roller is generally cylindrical in shape.

FIG. 3 illustrates the ridges and grooves formed around the outer circumference of tape roller 40 comprising parallel rings of ridges. As a result, only the tips of these ridges come in contact with adhesive tape 37. By removing portions of the cylinder by means of grooves or other periodic depression formation, the line of contact with adhesive tape 37 is reduced to a series of dots. This surface is employed on roller 40 so that the area of contact formed by roller 40 with the planar surface of tape 37 is substantially reduced. As a result, very little adhesive will have an opportunity to contact and maintain a grip on guide roller 40.

The employment of ridges on guide roller 40 does not need to be regular pattern, and does not need to consist of pointed ridges. However, the use of ridges is preferred. The peaks could be randomly distributed. The same is true of wall area 41. The wall, of course, does not require the advantage of guide roller 40 which can rotate away and break free of tape attachment. However, the wall area 41 does provide for a reduced surface area for adhesive tape attachment aiding in the control and manage of the movement of adhesive tape 37. Other locations are possible for wall area 41 within the structure of label tape cassette.

Figure 4B:
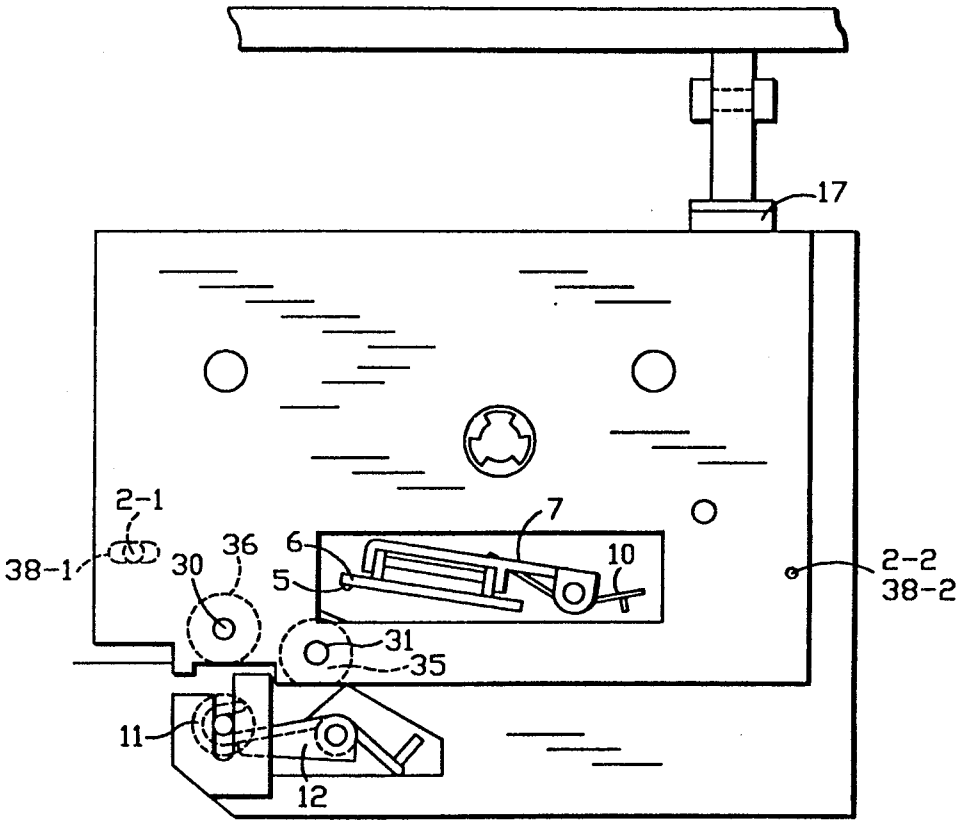
FIG. 4B is a top view of the mechanism of FIG. 4A. To be noted is that thermal print head 5 is retracted from platen roller 35 and pinch rollers 11 and 36 are in their opened position.
Figure 4A:
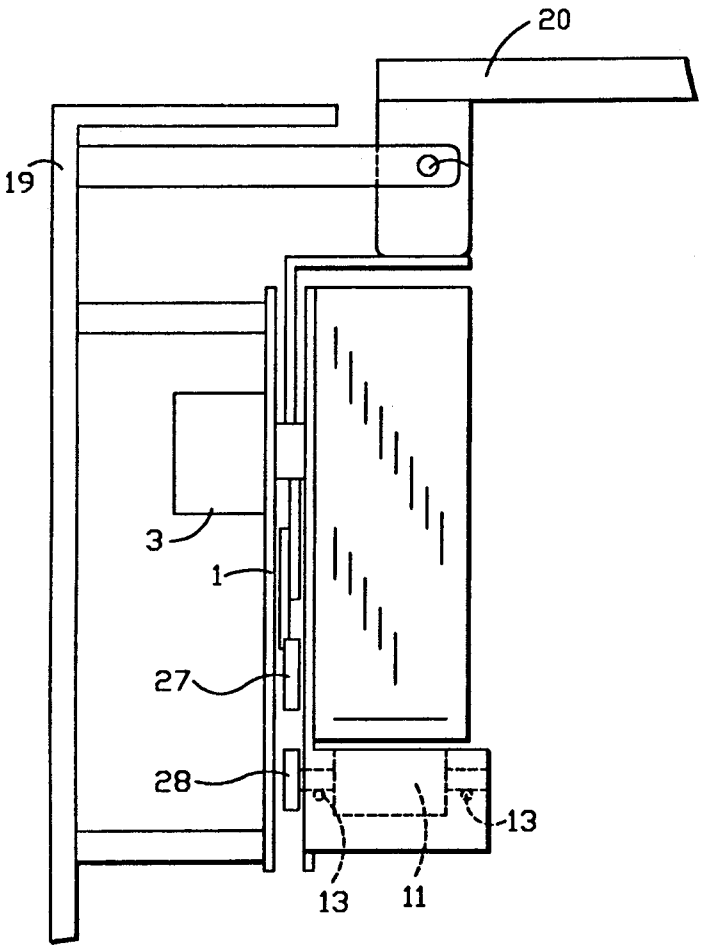
FIG. 4A is an end view of the label tape cassette drive mechanism of FIGS. 1A-1B with a cassette loading cover on the printer in its open position.

FIGS. 4A-4B illustrate a tape cassette in position in the label printer with cover 20 in its open position. Holes 38-1 and 38-2 at the underside of cassette case bottom 38 engage tape cassette alignment shafts 2-1 and 2-2 to align the cassette in the correct position in the printer. Print head 5 and tape feed roller 11 are shown in their retracted positions so that they do not interfere with the installing or removing of the cassette from the printer.

Figure 1A:
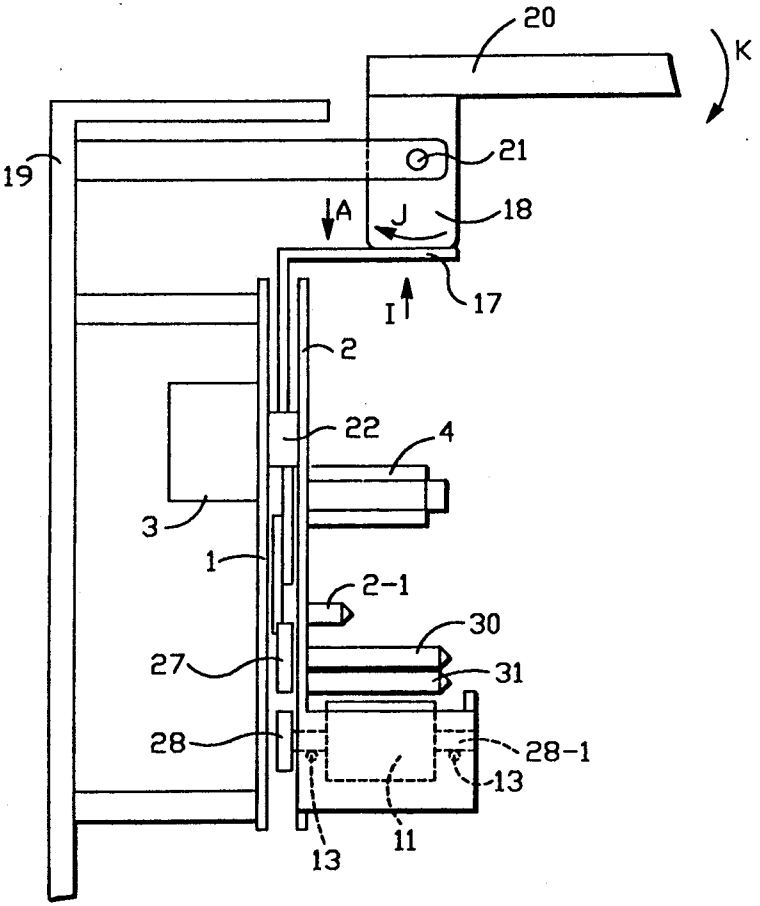
FIG. 1A is an end view of a label tape cassette drive mechanism for use in a printer according to this invention.
Figure 5B:
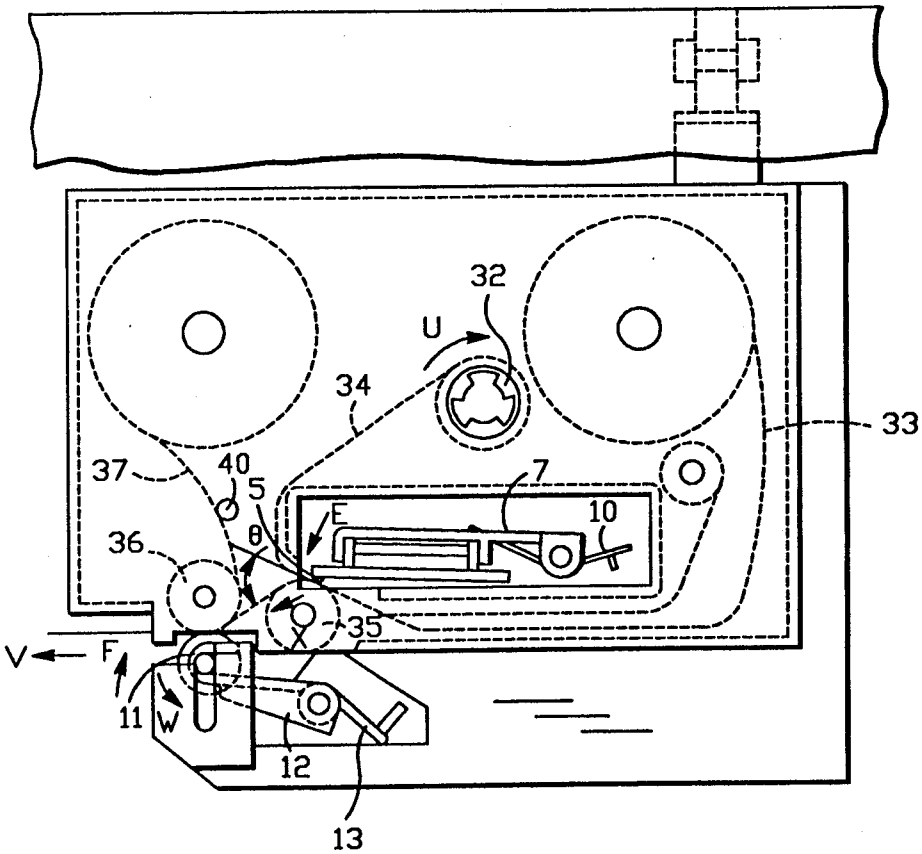
FIG. 5B is a top view of the mechanism of FIG. 5A. To be noted is that thermal print head 5 is loaded against platen roller 35 with ink ribbon 34 and transparent tape 33 pinched therebetween, and pinch rollers 11 and 36 are in their closed position.
Figure 5A:
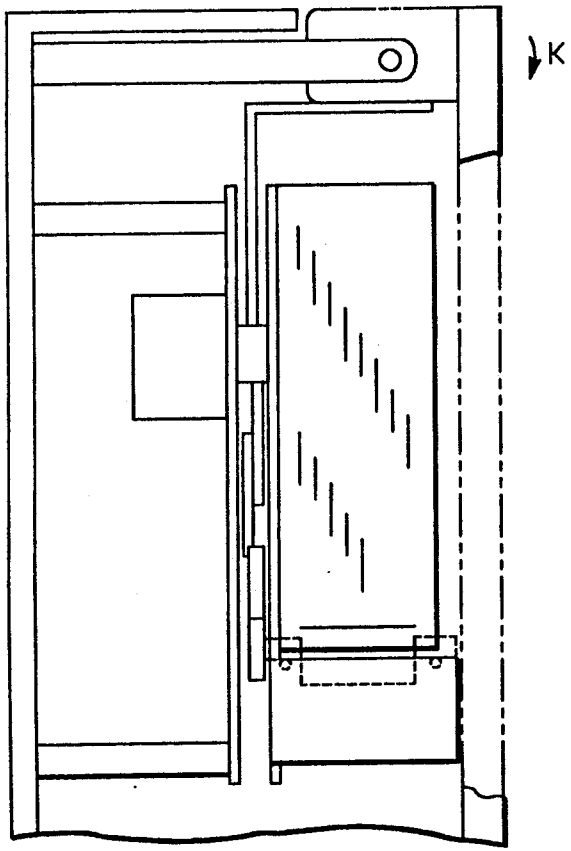
FIG. 5A is an end view of the label tape cassette drive mechanism with a cassette loading cover on the printer in its closed position.

FIGS. 5A-5B are similar to FIGS. 4A-4B, but in the case here the cover 20 is in the closed position. Print head 5 and tape feed roller 11 are, therefore, in their operational positions, preventing any attempt to insert or remove a cassette. By rotating cover 20 in the direction of arrow "K", as shown in FIG. 1A, head arm 7 rotates in direction "E" and arm 12 moves in the direction indicated by arrow "F". As a result, print head 5 is loaded under the force of head hold-down spring 10 contacting platen roller 35 on an installed cassette. In addition, tape feed roller 11 is forced by tape feed roller spring 13 to be in engagement with tape hold-down roller 36 on an installed cassette. Tape feed transfer gear 27 and tape feed gear 28 are then engaged. This is termed the "printing enabled" condition.

Figure 6:
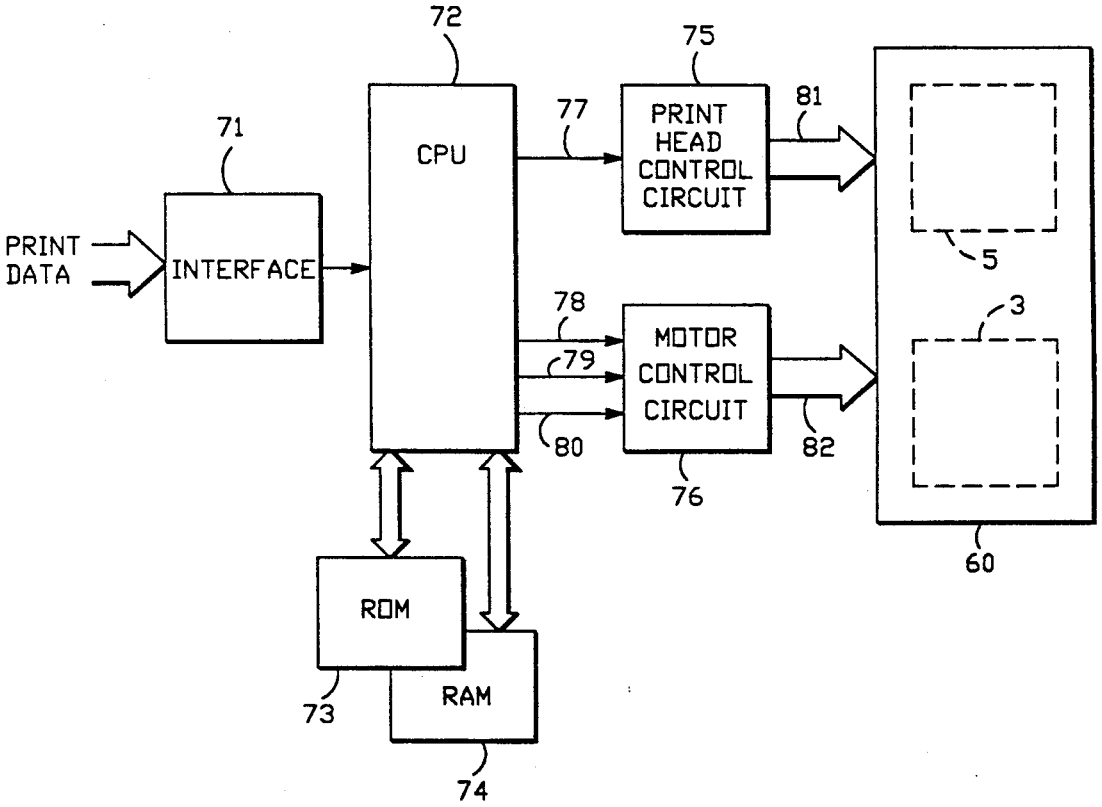
FIG. 6 is a block diagram of the computer control unit for the label tape printer.

FIG. 6 illustrates a complete system for printing comprising print mechanism 60 having, as its principal parts, print head 5 and motor 3; CPU 72; print head control circuit 75; motor control circuit 76; interface 71; and memory comprising ROM 73 and RAM 74. The electronics may be comprised of a microcomputer or personal computer system with appropriate software. Preferably, a small microcomputer is employed so that the entire electronics control package may be placed in housing 19, shown in FIG. 8. CPU 72 provides print head control signals 77 to print head control circuit 75, which, in turn, outputs print head drive signal 81 to print head 5. A pair of motor direction signals, comprising signal 78, representing a forward direction, and signal 79, representing a reverse direction and stepper motor signal 80 from CPU 72 are applied to motor control circuit 76 to form motor drive siganl 82 to selectively drive motor 3. Print data is received at interface 71, which is temporarily stored in RAM 74. The CPU 72 translates this data using character font data in ROM 73 to provide coordinate signals 81 and 82 to effect printing on label tape 33.

Figure 7:
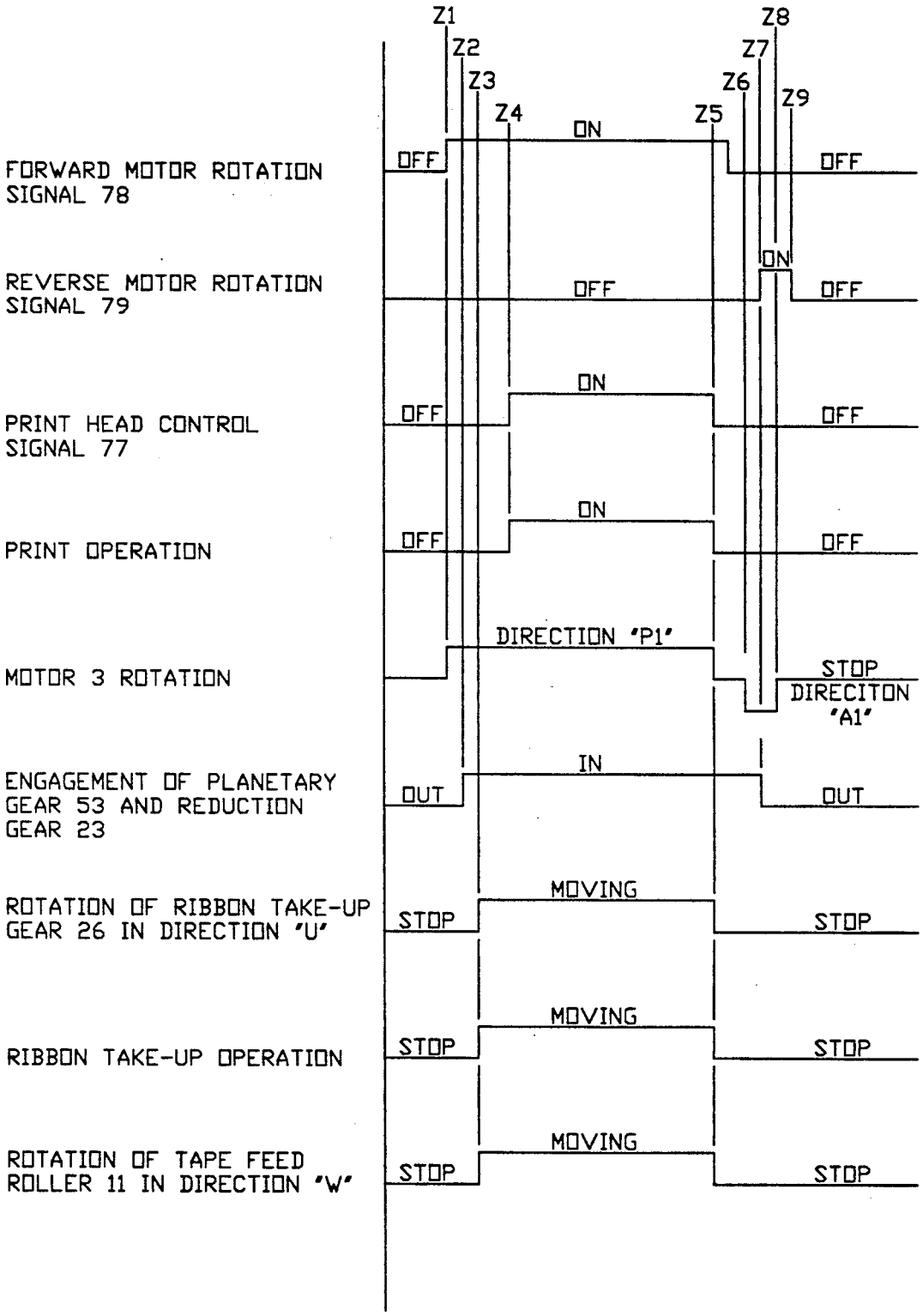
FIG. 7 is a timing chart showing the operative sequence of various printer control signals, gears and motors operations.

FIG. 7 illustrates, in a simplified manner, the basic signal coordination and timing required between coordinate signals 81 and 82. Starting at time "Z1", signal 78 and 80 cause motor 3 to rotate in a forward direction indicated by arrow "P1", as indicated in FIG. 1B. This causes gear assembhly frame 51 to rotate in direction indicated by arrow "Q1", such that planetary gear 53 engages with reduction gear 23, as indicated at time "Z2". If motor 3 operation is maintained, planetary gear 53 will turn in a direction indicated by arrow "R" so that reduction gear 23 turns in a direction indicated by arrow "S" so that transfer gear 25 rotates in a direction indicated by arrow "X", tape feed transfer gear 27 rotates in a direction indicated by arrow "T" and ribbon transfer gear 24 turns in a direction indicated by arrow "Y". Ribbon take-up gear 26 rotates in a direction indicated by arrow "U", corresponding to time "Z3". Tape feed transfer gear 27 turns in direction "T" to rotate tape feed gear 28 in a direction indicated by arrow "W", shown in FIG. 1B. Referring also to FIG. 5B, tape feed roller 11 roates in direction "W", since it is directly coupled to tape feed gear 28. Transparent tape 33 and adhesive tape 37, which is pressed together at this point, are, therefore, feed out of the exit in a direction indicated by arrow "V" in FIG. 5B. Transparent label tape 33 feeds past print head 5, in a direction indicated by arrow "X". To prevent thermally transferred ink on label tape 33 from smudging, thermal ink ribbon 34 is fed past platen roller 35 at approximately the same speed as transparent tape 33. Thermal ink ribbon 34 could tend to sag between print head 5 and ribbon take-up core 32, but ribbon take up core 32 will rotate in direction "U" to maintain ribbon 34 taunt. As a result, no slack will normally appear in thermal ink ribbon 34 in its travel between print head 5 and core 32.

While transparent tape 33 moves in direction "X", a signal 77 is sent to circuit 75, as indicated at times "Z4" to "Z5" in FIG. 7. Sending signal print head drive signals 81 to print head 5 causes transparent label tape 33 to be printed. Transparent label tape 33 is fixed onto adhesive tape 37 between rollers 36 and 11 and exits in the direction indicated by arrow "V". When printing is done, motor forward rotation signal 78 ceases and motor 3 stops, as indicated in time "Z6". To disengage gear 53 from the rest of the drive train, motor 3 is reversed by means of signal 79 in time "Z7", and motor 3 turns in a direction indicated by "P2" so that gear assembly frame 51 swings away from gear 23 in a direction indicated by arrow "Q2" and planetary gear 53 disengages from reduction gear 23 time "Z8". Reverse signal 79 ceases and motor 3 stops in time "Z9". At this point in time, the gear train from tape feed gear 28 to ribbon take-up gear 26 is free to turn without interference with the engaged load of motor 3. A user may pull on the composite label/adhesive tape in the direction "V", which will rotate rollers 11 and 36 rather than slip between them since the gear train is free winding and is not held up by motor, as is the case in conventional label printers. Ink ribbon take-up 26 will also be rotated via the train gear maintaining thermal ink ribbon 34 taunt and continually wound onto core 32 without sagging as the composite tape is pulled from the printer exit.

Figure 8:
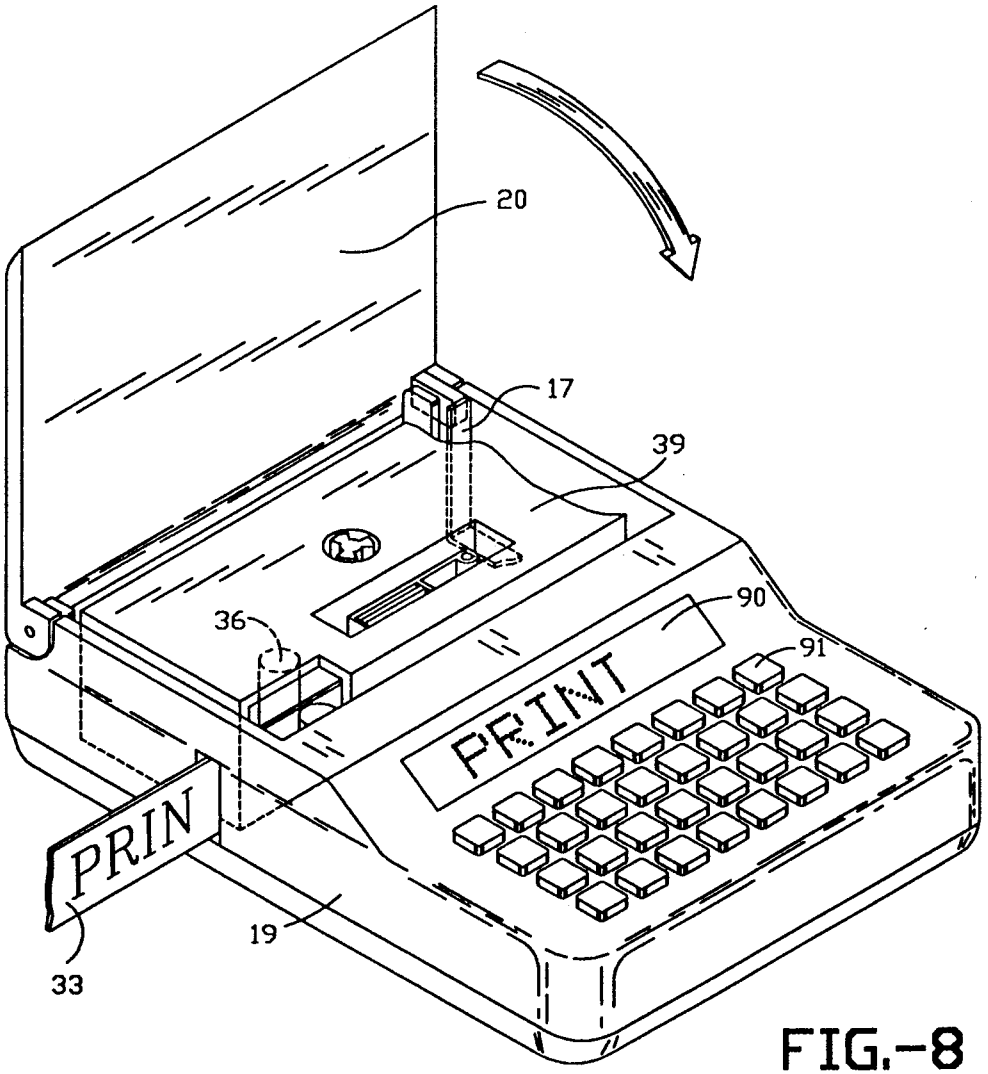
FIG. 8 is a perspective view of a complete label making printer incorporating the print mechanism and label tape cassette of this invention with the cassette loading cover open exposing the cassette for service. The finished label tape is shown exiting the left side of the printer with the printed letters, "PRIN", visible from the printer and the word "PRINT" displayed on an LCD panel of the printer.

FIG. 8 shows the portable printer of this invention including the foregoing described printer mechanism and cassette. An LCD display 90 in the printer shows a user the entries that have been made at keyboard 91. The "Print Data" of FIG. 6 can be sourced from keyboard 91 in lieu of interface 71 through the provision of appropriate circuits. The construction of a microcomputer to read a keyboard and drive an LCD display are conventional so that their explanation is not required here.

While the invention has been described in conjunction with several specific embodiments, it is evident to those skilled in the art that many further alternatives, modifications and variations is apparent in light of the foregoing description. For example, a one-way clutch placed on motor 3, instead of the planetary gear system described above, will also provide acceptable results. Such a one-way clutch will transmit power from a shaft S1 to a shaft S2 in one direction, but not the other. In the other direction, shafts S1 and S2 will be free wheeling. Such mechanisms are conventional in automobile automatic transmissions. Thus, the invention described herein is intended to embrace all such alternatives, modifications, applications and variations as may fall within the spirit and scope of the appended claims.

What is claimed is:

1. A label tape printing system for applying ink from an ink ribbon to a surface of a label tape both of which are drawn past a print station in said printing system, comprising:

ink transfer head at said print station for selectively transferring ink from said ink ribbon to said label tape surface;

a motor capable of being driven in a first direction; and a second direction tape feed means for transporting said label tape past said print station and out an exit of said printing system;

ribbon winding means for transporting said ink ribbon past said print station and for wind up on a take-up reel in said printing system;

said tape feeding and ribbon winding means coupled together so that said ink ribbon and said babel tape are moved in unison via said motor at substantially the same speed past said print station; and means to permit unobstructed movement of said tape feeding and ribbon winding means comprising coupling means for engaging and disengaging said motor respectively to and from said tape feeding and ribbon winding means so that when said motor is operated in said first direction, said motor is engaged with said tape feeding and ribbon winding means to simultaneously drive said label tape and said ink ribbon past said print station for permitting printing on said label tape surface, and when said motor rotates in said second direction, said motor is disengaged from said tape feeding and ribbon winding means permitting said unobstructed movement of said tape feeding and ribbon winding means permitting unobstructed removal of said label tape from said exit with concurrent wind up of said ink ribbon on said take-up reel.

2. The tape printing system of claim 1 wherein said coupling means comprises a planetary mechanism having a planetary lever and planetary gears in an epicyclic arrangement.

3. The tape printing system in claim 1 wherein:

said ink ribbon and label tape are disposed within a tape cassette;

an adhesive tape on an adhesive tape supply roller contained in said tape cassette and drawn by said tape feeding and ribbon winding means from said adhesive tape supply roller for engagement with said label tape surface at said exit; and at least one guide surface for engagement and guiding of said adhesive tape in its path of travel between said adhesive tape supply roller and said exit, said at least one guide surface having a plurality of surface projections for providing minimal surface engagement between said adhesive tape and said at least one guide surface, said at least one guide surface positioned in said tape cassette for maintaining said adhesive tape from coming into contact with any portion of said tape cassette other than said label tape surface.

4. The tape printing system of claim 1 further comprising means to turn said motor in said second direction a predetermined amount after completing a printing operation.

5. The tape printing system of claim 1 wherein:

said ink ribbon and label tape are disposed within a tape cassette;

an adhesive tape on an adhesive tape supply roller contained in said tape cassette and drawn by said tape feeding and ribbon winding means from said adhesive tape supply roller for engagement with said label tape surface at said exit; and at least one guide roller rotatable on a central longitudinal axis and with a circumferential surface having a plurality of surface projections disposed around said surface in a direction substantially perpendicular to said longitudinal axis, said guide roller positioned in said tape cassette for providing minimal surface engagement between said adhesive tape and said guide roller surface and for maintaining said adhesive tape from coming into contact with any portion of said tape cassette other than said label tape surface.

6. The apparatus of claim 1 wherein said coupling means in configured to engage said motor for driving said tape feeding and ribbon winding means during printing operations and disengage said motor from driving said tape feeding and ribbon winding means after cessation of printing operations.

7. A label tape cassette printer for use with an ink ribbon in applying ink images to a label tape, comprising:

a base support in said printer for holding a label tape cassette;

a motor on said printer base support;

an ink ribbon take-up reel in said cassette for receipt and wind up of spent ink ribbon;

an exit in said cassette for output of said label tape;

a drive gear train configured to apply a rotary type drive motion to advance said ink ribbon take-up reel concurrently with said label tape so as to retrieve said label tape and said ink ribbon from respective supply reels in said cassette;

means to permit engagement and disengagement of said drive gear train relative to said motor to respective permit direct drive of said drive gear train during printing operations and unobstructed movement of said drive gear train either upon cessation of printing operations or during printing operations when said drive gear train is subjected to a faster rotational rate to advance said ink ribbon take-up reel due to said label tape being pulled from said exit compared to a rotational rate provided by said motor to said drive gear train to advance said ink ribbon take-up reel.

8. The label tape cassette printer of claim 7 wherein said engagement and disengagement means comprises a one-way clutch.

9. The label tape cassette printer of claim 7 wherein said engagement and disengagement means comprises a rotatable frame rotatably supported relative to said motor and having a planetary gear rotated by a drive gear of said motor.

* * * * *